US010797400B1

(12) United States Patent
Henderson et al.

(10) Patent No.: US 10,797,400 B1
(45) Date of Patent: Oct. 6, 2020

(54) HIGH COMPACTION RATIO REFLECTOR ANTENNA WITH OFFSET OPTICS

(71) Applicant: Eagle Technology, LLC, Melbourne, FL (US)

(72) Inventors: Philip J. Henderson, Palm Bay, FL (US); Robert M. Taylor, Rockledge, FL (US); Timothy L. Fetterman, Palm Bay, FL (US); Christopher L. Rose, Palm Bay, FL (US)

(73) Assignee: Eagle Technology, LLC, Melbourne, FL (US)

( * ) Notice: Subject to any disclaimer, the term of this patent is extended or adjusted under 35 U.S.C. 154(b) by 22 days.

(21) Appl. No.: 16/353,287

(22) Filed: Mar. 14, 2019

(51) Int. Cl.
*H01Q 15/14* (2006.01)
*H01Q 1/12* (2006.01)
*H01Q 15/16* (2006.01)

(52) U.S. Cl.
CPC ..... *H01Q 15/147* (2013.01); *H01Q 1/1228* (2013.01); *H01Q 15/161* (2013.01)

(58) Field of Classification Search
CPC .. H01Q 15/147; H01Q 15/161; H01Q 1/1228; H01Q 1/1235
See application file for complete search history.

(56) References Cited

U.S. PATENT DOCUMENTS 2,806,134 A 9/1957 Tarcici
3,064,534 A 11/1962 Tumavicus
3,165,751 A 1/1965 Clark
3,174,397 A 3/1965 Sanborn
3,179,211 A 4/1965 Dunlavy
3,217,328 A 11/1965 Miller
3,224,007 A 12/1965 Mathis
3,360,798 A 12/1967 Webb
3,385,397 A 5/1968 Robinsky
3,397,399 A 8/1968 Carman et al.
(Continued)

FOREIGN PATENT DOCUMENTS

EP 0959524 A1 11/1999

OTHER PUBLICATIONS

Kovitz, Joshua M., et al., "A spline-profiled conical horn antenna assembly optimized for deployable Ka-band offset reflector antennas in CubeSats," Published in 2016 IEEE International Symposium on Antennas.

(Continued)

*Primary Examiner* — Daniel D Chang
(74) *Attorney, Agent, or Firm* — Fox Rothschild LLP; Robert J. Sacco; Carol E. Thorstad-Forsyth

(57) ABSTRACT

A reflector system includes a hoop assembly formed of a plurality of link members extending between a plurality of hinge bodies. The link members have an expanded configuration wherein the link members define a circumferential hoop having a central hoop axis. A collapsible mesh reflector surface is secured to the hoop such that when the hoop assembly is in the expanded configuration, the reflector surface is expanded to a shape that is intended to concentrate RF energy. A mast assembly includes an extendible boom aligned along a central boom axis. The hoop assembly is secured by a plurality of cords relative to the boom such that when the hoop is expanded, a central hoop axis is laterally offset a predetermined distance from the central boom axis.

20 Claims, 9 Drawing Sheets

(56) References Cited

U.S. PATENT DOCUMENTS 3,406,404 A 10/1968 Maier
3,473,758 A 10/1969 Webb
3,477,662 A 11/1969 Anderson
3,496,687 A 2/1970 Greenberg et al.
3,509,576 A 4/1970 McLain
3,510,086 A 5/1970 Arbeitlang et al.
3,521,290 A 7/1970 Bahiman et al.
3,530,469 A 9/1970 Dailey et al.
3,541,569 A 11/1970 Berks et al.
3,558,219 A 1/1971 Buckingham et al.
3,576,566 A 4/1971 Cover, Jr. et al.
3,617,113 A 11/1971 Hoyer
3,618,111 A 11/1971 Vaughan
3,715,760 A 2/1973 Palmer
3,735,942 A 5/1973 Palz
3,735,943 A 5/1973 Fayet
3,817,481 A 6/1974 Berks et al.
3,863,870 A 2/1975 Andrews et al.
3,913,105 A 10/1975 Williamson et al.
3,978,490 A 8/1976 Fletcher et al.
4,030,102 A 6/1977 Kaplan et al.
4,030,103 A 6/1977 Campbell
4,115,784 A 9/1978 Schwerdffeger et al.
4,133,501 A 1/1979 Pentlicki
4,315,265 A 2/1982 Palmer et al.
4,337,560 A 7/1982 Slysh
4,352,113 A 9/1982 Labruyere
4,380,013 A 4/1983 Slysh
4,475,323 A 10/1984 Schwartzberg et al.
4,482,900 A 11/1984 Bilek et al.
4,498,087 A 2/1985 Imbiel et al.
4,511,901 A 4/1985 Westphal
4,527,166 A 7/1985 Luly
4,578,920 A 4/1986 Bush et al.
4,613,870 A 9/1986 Stonier
4,636,579 A 1/1987 Hanak et al.
4,642,652 A 2/1987 Herbig et al.
4,646,102 A 2/1987 Akaeda et al.
4,658,265 A 4/1987 Heinze et al.
4,713,492 A 12/1987 Hanak
4,727,932 A 3/1988 Mahefkey
4,747,567 A 5/1988 Johnson et al.
4,769,647 A 9/1988 Herbig et al.
4,780,726 A 10/1988 Archer et al.
4,787,580 A 11/1988 Ganssle
4,811,034 A 3/1989 Kaminskas
4,825,225 A 4/1989 Waters et al.
4,862,190 A 8/1989 Palmer et al.
4,899,167 A 2/1990 Westphal
4,926,181 A 5/1990 Stumm
4,989,015 A 1/1991 Chang
5,016,418 A 5/1991 Rhodes et al.
5,104,211 A 4/1992 Schumacher et al.
5,198,832 A 3/1993 Higgins et al.
5,296,044 A 3/1994 Harvey et al.
5,446,474 A 8/1995 Wade et al.
5,451,975 A 9/1995 Miller et al.
5,487,791 A 1/1996 Everman et al.
5,488,383 A 1/1996 Friedman et al.
5,515,067 A 5/1996 Rits
5,520,747 A 5/1996 Marks
5,574,472 A 11/1996 Robinson
5,644,322 A 7/1997 Hayes et al.
5,680,145 A 10/1997 Thomson et al.
5,700,337 A 12/1997 Jacobs et al.
5,720,452 A 2/1998 Mutschler, Jr.
5,785,280 A 7/1998 Baghdasarian
5,787,671 A 8/1998 Meguro et al.
5,833,176 A 11/1998 Rubin et al.
5,857,648 A 1/1999 Dailey et al.
5,864,324 A 1/1999 Acker et al.
5,927,654 A 7/1999 Foley et al.
5,963,182 A 10/1999 Bassily
5,968,641 A 10/1999 Lewis
5,990,851 A 11/1999 Henderson et al.
6,017,002 A 1/2000 Burke et al.
6,028,569 A 2/2000 Bassily et al.
6,028,570 A 2/2000 Gilger et al.
6,104,358 A 8/2000 Parker et al.
6,137,454 A 10/2000 Peck
6,150,995 A 11/2000 Gilger
6,208,317 B1 3/2001 Taylor et al.
6,219,009 B1 4/2001 Shipley et al.
6,225,965 B1 5/2001 Gilger et al.
6,228,441 B1 5/2001 Suzuki et al.
6,243,053 B1 6/2001 Shtarkman
6,278,416 B1 8/2001 Harless
6,313,811 B1 11/2001 Harless
6,321,503 B1 11/2001 Warren
6,323,827 B1 11/2001 Gilger et al.
6,343,442 B1 2/2002 Marks
6,344,835 B1 2/2002 Allen et al.
6,353,421 B1 3/2002 Lalezari et al.
6,373,449 B1 4/2002 Bokulic et al.
6,384,800 B1 5/2002 Bassily et al.
6,417,818 B2 7/2002 Shipley et al.
6,437,232 B1 8/2002 Dailey et al.
6,441,801 B1 8/2002 Knight et al.
6,478,261 B2 11/2002 Laraway et al.
6,542,132 B2 4/2003 Stern
6,547,190 B1 4/2003 Thompson et al.
6,568,638 B1 5/2003 Capots
6,581,883 B2 6/2003 McGee et al.
6,609,683 B2 8/2003 Bauer et al.
6,618,025 B2 9/2003 Harless
6,624,796 B1 9/2003 Talley et al.
6,637,702 B1 10/2003 McCandless
6,702,976 B2 3/2004 Sokolowski
6,735,920 B1 5/2004 Cadogan
6,772,479 B2 8/2004 Hinkley et al.
6,775,046 B2 8/2004 Hill et al.
6,828,949 B2 12/2004 Harless
6,872,433 B2 3/2005 Seward et al.
6,930,654 B2 8/2005 Schmid et al.
6,956,696 B2 10/2005 Hachkowski et al.
6,983,914 B2 1/2006 Stribling et al.
7,009,578 B2 3/2006 Nolan et al.
7,059,094 B2 6/2006 Yamawaki
7,098,867 B1 8/2006 Gullapalli
7,216,995 B2 5/2007 Harada et al.
7,429,074 B2 9/2008 Mc Knight et al.
7,595,769 B2 9/2009 Bassily
7,686,255 B2 3/2010 Harris
7,710,348 B2 5/2010 Taylor et al.
7,806,370 B2 10/2010 Beidleman et al.
7,897,225 B2 3/2011 Campbell et al.
8,061,660 B2 11/2011 Beidleman et al.
8,066,227 B2 11/2011 Keller et al.
8,109,472 B1 2/2012 Keller et al.
8,259,033 B2 9/2012 Taylor et al.
8,289,221 B1 10/2012 Finucane
8,356,774 B1 1/2013 Banik et al.
8,462,078 B2 6/2013 Murphey et al.
8,654,033 B2 2/2014 Sorrell et al.
8,789,796 B2 7/2014 Boccio et al.
8,839,585 B2 9/2014 Santiago Prowald et al.
9,112,282 B2 8/2015 Nurnberger et al.
9,153,860 B2 10/2015 Tserodze et al.
9,281,569 B2 3/2016 Taylor et al.
9,331,394 B2 5/2016 Toledo
9,484,636 B2 11/2016 Mobrem
9,496,621 B2 11/2016 Meschini et al.
9,608,333 B1 * 3/2017 Toledo ..... H01Q 1/14
9,660,351 B2 5/2017 Medzmariashvili et al.
9,714,519 B2 7/2017 Slade
9,755,318 B2 9/2017 Mobrem et al.
9,774,092 B2 9/2017 Fujii et al.
9,815,574 B2 11/2017 Scolamiero et al.
10,131,452 B1 11/2018 Rohweller et al.
10,418,712 B1 * 9/2019 Henderson ..... H01Q 15/161
2002/0063660 A1 5/2002 Harless
2003/0201949 A1 10/2003 Harless
2013/0186011 A1 7/2013 Keller et al.
2015/0194733 A1 7/2015 Mobrem et al.

(56) References Cited

U.S. PATENT DOCUMENTS

| | | | |
|---|---|---|---|
| 2015/0236416 | A1 | 8/2015 | Fonseca |
| 2015/0244081 | A1 | 8/2015 | Mobrem |
| 2015/0288072 | A1 | 10/2015 | Medzmariashvili et al. |
| 2015/0303582 | A1 | 10/2015 | Meschini et al. |
| 2016/0352022 | A1 | 12/2016 | Thomson et al. |
| 2017/0256840 | A1 | 9/2017 | Walker et al. |

OTHER PUBLICATIONS

Peral, Eva, et al., "Radar Technologies for Earth Remote Sensing from CubeSat Platforms," Published in Proceedings of IEEE vol. 106, issue 3, Mar. 2018.

KaTENna—Deployable High Gain Antenna for Small Satellites, Antennas & Precision Deployables for Space, TENDEG LLC www.tendeg.com.

European Search Report issued in European Patent Application No. 20152614 dated Jul. 15, 2020.

* cited by examiner

HIGH COMPACTION RATIO REFLECTOR ANTENNA WITH OFFSET OPTICS

BACKGROUND

Statement of the Technical Field

The technical field of this disclosure concerns compact antenna system structures, and more particularly, compact deployable reflector antenna systems.

Description of the Related Art

Various conventional antenna structures exist that include a reflector for directing energy into a desired pattern. One such conventional antenna structure is a hoop column reflector (HCR) type system, which is known to have a high compaction ratio. The HCR antenna system includes a hoop assembly, a collapsible mesh reflector surface and an extendible mast assembly. The hoop assembly includes a plurality of link members extending between a plurality of hinge bodies and the hoop assembly is moveable between a collapsed configuration wherein the link members extend substantially parallel to one another and an expanded configuration wherein the link members define a circumferential hoop. The reflector surface is secured to the hoop assembly and collapses and extends therewith. The hoop is secured by cords relative to top and bottom portions of a mast that maintains the hoop substantially in a plane. The mast extends to release the hoop, pull the mesh reflector surface into a shape that is intended to concentrate RF energy in a desired pattern, and tension the cords that locate the hoop. An example of an HCR type antenna system is disclosed in U.S. Pat. No. 9,608,333.

There is a market need for a low-cost, offset-fed reflector that can be easily modified for a wide variety of missions. Offset-fed reflectors are in great demand for antenna RF and system integration purposes as they potentially offer higher efficiency, reduced blockage and sidelobes, enable integration with separate feed subassemblies, and so on.

SUMMARY

This document concerns a reflector system for an antenna. The reflector system includes a hoop assembly comprising a plurality of link members extending between a plurality of hinge bodies. The hoop assembly is configured to automatically, passively expand between a collapsed configuration wherein the link members extend substantially parallel to one another and an expanded configuration wherein the link members define a circumferential hoop.

A collapsible mesh reflector surface is secured to the hoop assembly. Consequently, when the hoop assembly is in the collapsed configuration, the reflector surface is collapsed within the hoop assembly and when the hoop assembly is in the expanded configuration, the reflector surface is expanded to a predetermined shape that is intended to concentrate RF energy in a desired pattern.

The system also includes a mast assembly, which is comprised of an extendible boom. The hoop assembly is secured by a plurality of hoop positioning cords relative to a top portion of the boom. Further, a plurality of primary catenary cords secure the hoop assembly to a bottom portion of the boom. Consequently, upon extension of the boom to a deployed condition, the hoop assembly is supported by the boom. In this deployed condition, a central axis of the hoop assembly can be substantially parallel to the central axis of the extendible boom or they may be oriented at a slight angle. Unlike certain prior art antenna systems which may be configured with the mast centered inside the hoop, the mast for this reflector system is offset in position relative to a central axis of the hoop assembly. This offset is defined by a first predetermined distance when the hoop assembly is in the collapsed configuration, and a second predetermined distance greater than the first predetermined distance when the hoop assembly is in the expanded configuration. The predetermined shape of the reflector is defined by a perimeter shape of the hoop assembly when in the deployed condition, and the perimeter shape is fixed by a plurality of hoop stability cords which extend across the hoop assembly.

In addition to being supported by the hoop positioning cords and the primary catenary cords, the hoop assembly is also secured by a plurality of secondary catenary cords. Each of these secondary catenary cords respectively extends from an intermediate portion of the extendible boom to a corresponding primary catenary cord. Each of the secondary catenary cords is advantageously aligned in a cord plane with a corresponding one of the primary catenary cords and a corresponding one of the hoop positioning cords. In this regard it may be noted that the reflector can have a reflector surface contour. The reflector surface contour is determined by a plurality of surface shaping ties. These surface shaping ties extend between the reflector surface and at least one of the primary catenary cords and the secondary catenary cords.

In some scenarios, the extendible boom is comprised of a plurality of links that slide relative to one another, such that the extendible boom automatically extends from a collapsed configuration where the links are nested together and an expanded configuration wherein the link members extend substantially end to end. In other scenarios, the extendible boom is comprised of a spoolable extensible member.

The reflector system can also include a second hoop assembly. The second hoop assembly can include a second collapsible mesh reflector surface secured to the second hoop assembly. Consequently, when the second hoop assembly is in the collapsed configuration, the second collapsible mesh reflector surface is collapsed within the second hoop assembly and when the second hoop assembly is in the expanded configuration, the second collapsible mesh reflector surface is expanded to a second predetermined shape that is intended to concentrate RF energy in a second desired pattern. The second hoop assembly can expand in a manner similar to the first hoop assembly, and may include a similar arrangement of cords to establish a desired reflector shape. Consequently, a second central axis of the second hoop assembly can in some scenarios be substantially parallel to the central axis of the extendible boom, or in the alternative may be oriented at a slight angle. Further, the second central axis can be offset in position relative to the central axis of the extendible boom and relative to the central axis of the first hoop assembly.

The solution can also concern a method of deploying a reflector of a reflector system comprising a housing, a mast assembly, and a hoop assembly as described above. The method can involve extending the boom from the housing such that a cord tension between the hinges and the mast facilitates a controlled deployment of the hoop assembly. The hoop assembly is deployed in a position adjacent to the boom such that a central axis of the hoop assembly is substantially parallel with a central axis of the boom but is offset a predetermined distance. Consequently, the central axis of the boom is maintained external of a perimeter of the hoop assembly. The hoop assembly is urged out of the housing prior to fully deploying the boom in the manner described above.

BRIEF DESCRIPTION OF THE DRAWINGS

This disclosure is facilitated by reference to the following drawing figures, in which like numerals represent like items throughout the figures, and in which.

DETAILED DESCRIPTION

Figure 1A:
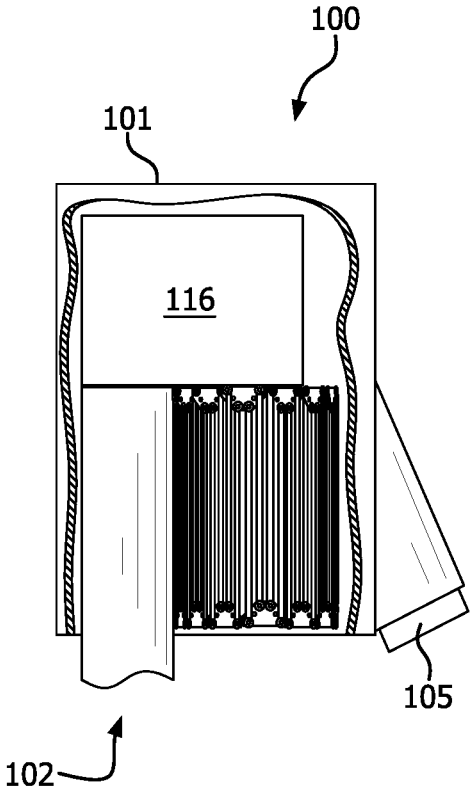
FIGS. 1A-1D are a series of drawings which are useful for understanding a process of deploying a reflector system.

It will be readily understood that the solution described herein and illustrated in the appended figures could involve a wide variety of different configurations. Thus, the following more detailed description, as represented in the figures, is not intended to limit the scope of the present disclosure, but is merely representative of certain implementations in various different scenarios. While the various aspects are presented in the drawings, the drawings are not necessarily drawn to scale unless specifically indicated.

Reference throughout this specification to features, advantages, or similar language does not imply that all of the features and advantages that may be realized should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Shown in FIGS. 1A-1D (collectively FIG. 1) is a deployable mesh reflector system 100. The deployable mesh reflector system 100 generally comprises a housing or container 101 which defines an interior space for stowing of a mast assembly 102 and a reflector assembly 103. The mast assembly 102 is securely mounted within the housing and includes an extendable boom 107. The reflector assembly 103 generally comprises a collapsible, mesh reflector surface 106 which is supported by a circumferential hoop assembly 104. The circumferential hoop assembly 104 is secured to an intermediate portion of the boom 107.

Figure 1B:
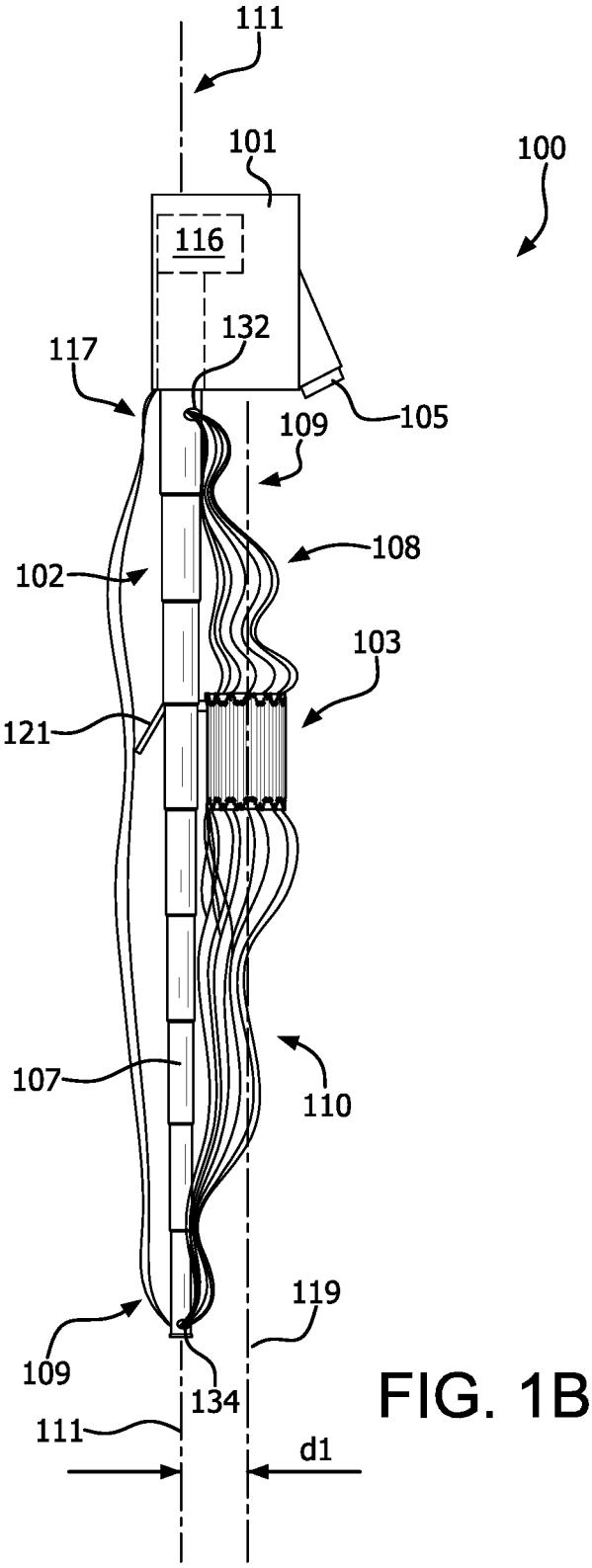
Figure 1C:
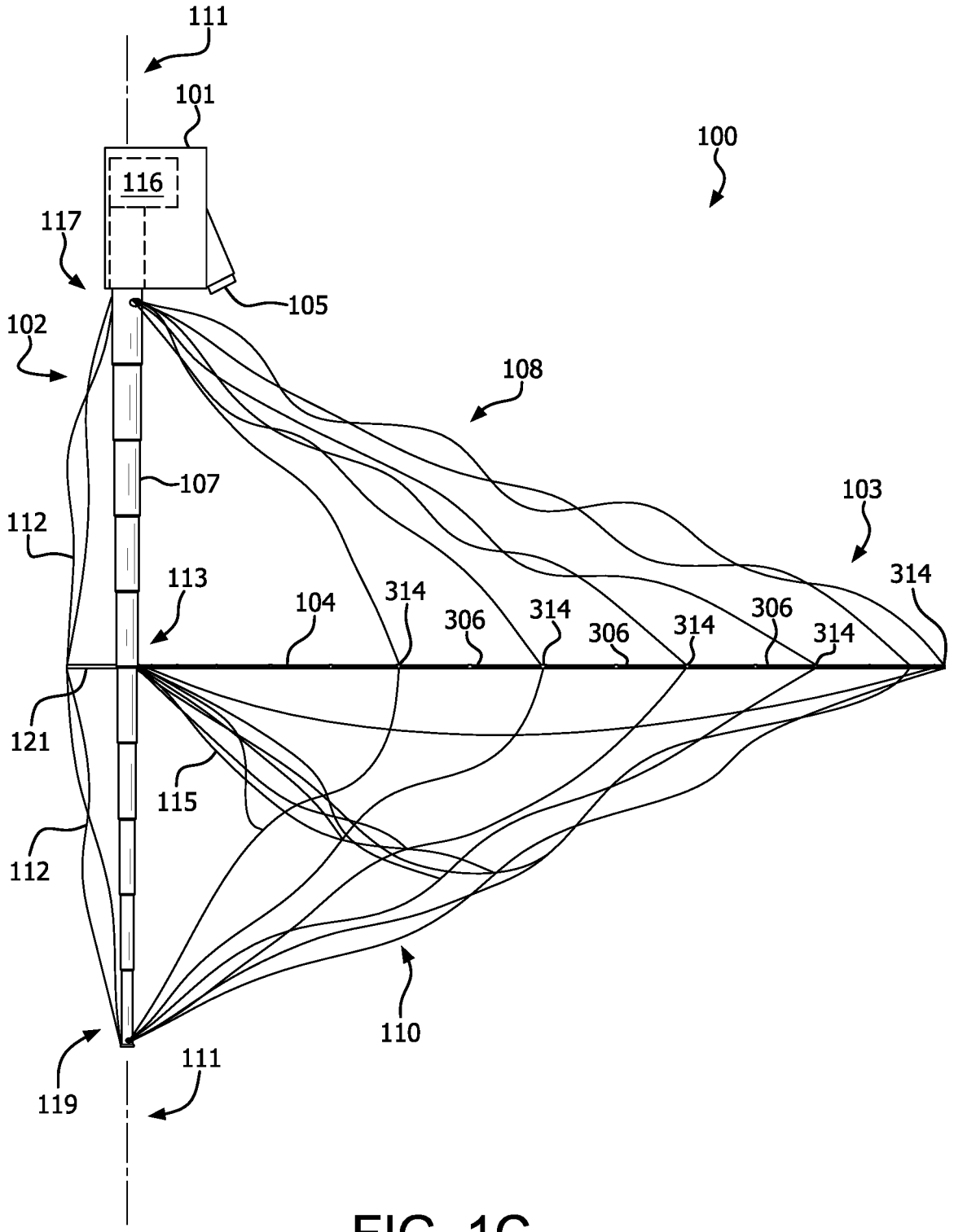

As illustrated in FIG. 1A, the reflector assembly 103 and the mast assembly 102 are configured to collapse into a stowed configuration which fits within the interior space of the housing 101. When the antenna system arrives at a deployment location (e.g., an orbital location) the antenna can be transitioned from the stowed configuration shown in 1A to the deployed configuration shown in FIG. 1D. Intermediate steps in this process are illustrated in FIGS. 1B and 1C. The hoop assembly 104, which is attached to an intermediate portion of the boom 107, is urged from the housing 101 when the boom is extended. The transition to the deployed configuration including tensioning of the cords is facilitated by extension of the boom 107 to its full length shown in FIG. 1D. A perspective view of the fully deployed mast assembly 102 and reflector assembly 103 is shown in FIG. 2. The housing 101 is omitted in FIG. 2 to facilitate an improved understanding of the reflector assembly.

In some scenarios, the housing 101 can comprise a portion of a spacecraft which comprises various types of equipment, including radio communication equipment. The radio communication equipment can include a radio frequency (RF) feed 105 which is used for illuminating the reflector with RF energy in a transmit mode, and for receiving RF energy which is focused by the reflector on the feed 105 in a receive direction. Accordingly, the combination of the RF feed 105 and the reflector system 100 can facilitate a reflector type antenna system.

The housing 101 may have various configurations and sizes depending on the size of the reflector assembly 103. By way of example, the system 100 may include a deployable mesh reflector with a 1 meter aperture that is stowed within a housing 101 that is of 2 U cubes at packaging and having an approximately 10 cm×10 cm×20 cm volume. Alternatively, the system 100 may include a deployable mesh reflector with a 3 meter aperture that is stowed within a housing 101 that is of 12 U cubes at packaging and having an approximately 20 cm×20 cm×30 cm volume. Of course, the solution is not limited in this regard and other sizes and configurations of the systems are also possible. In some scenarios, the housing 101 is in the nanosat or microsat size range.

The hoop assembly 104 is supported on the boom 107 by means of a plurality of cords. The cords are attached to the boom by anchors 132, 134 which are located respectively at a top and bottom portion 117, 119 of the boom. Anchors 132, 134 can be any structure that is suitable for securing the ends of the cords to the top and bottom portions of the boom. The cords include a plurality of hoop positioning cords 108 which extend to the hoop assembly from anchor 132 at the top portion 117 of the boom, and a plurality of primary catenary cords 110 which extend to anchor 134 at the bottom portion 119 of the boom. In some scenarios, the hoop positioning cords and the primary catenary cords can be attached to the hoop assembly 104 at selected ones of a plurality of hinge bodies 314. These hinge bodies 314 are described below in greater detail in relation to the description of the hoop assembly.

Figure 1D:
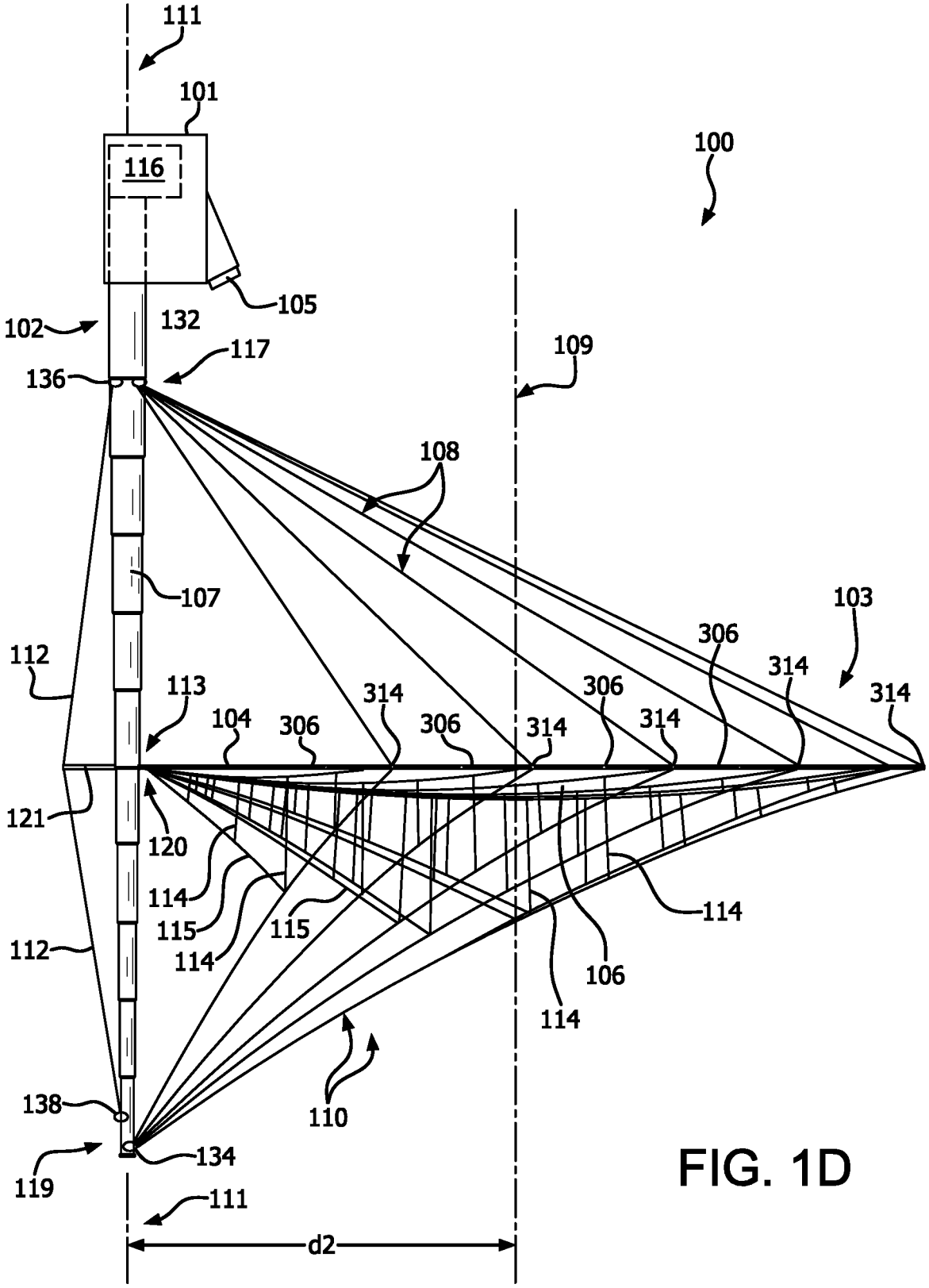
Figure 2:
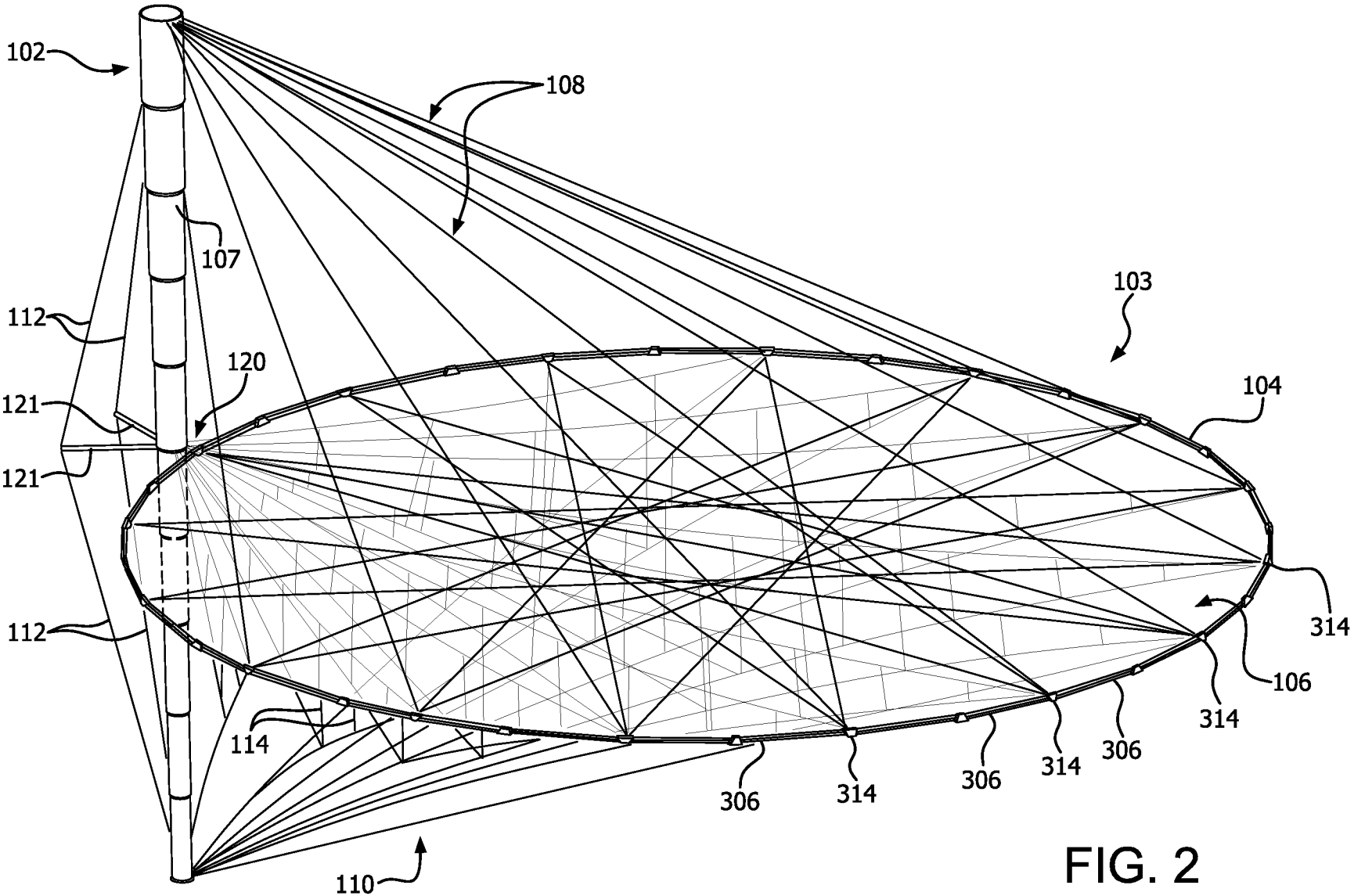
FIG. 2 is an isometric view of the reflector system when fully deployed.
Figure 3B:
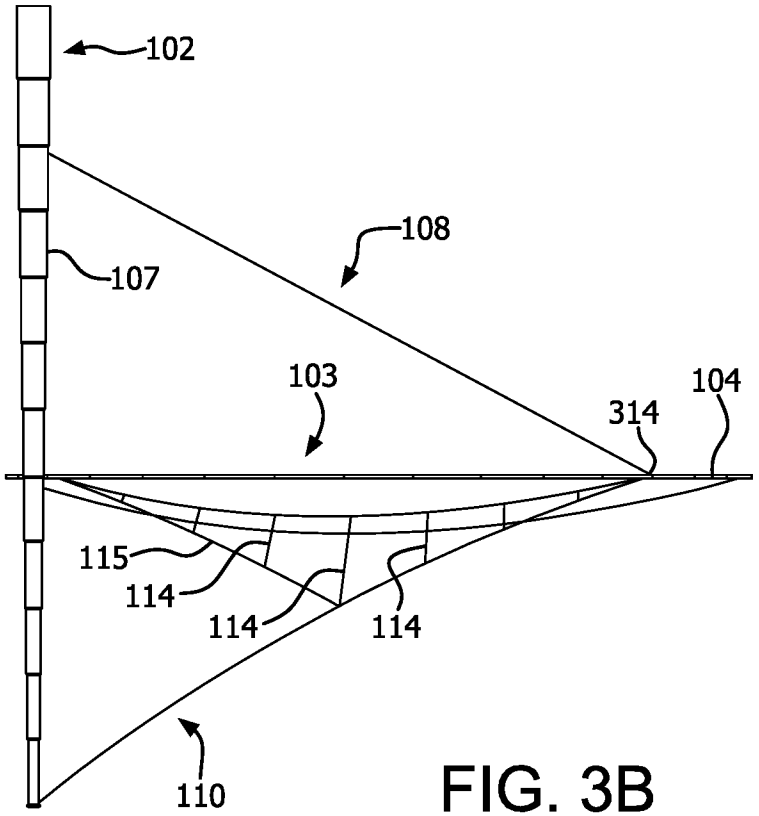
FIGS. 3A and 3B are a series of drawings which are useful for understanding an alignment of certain cords which are used to support the reflector system on a mast assembly.
Figure 3A:
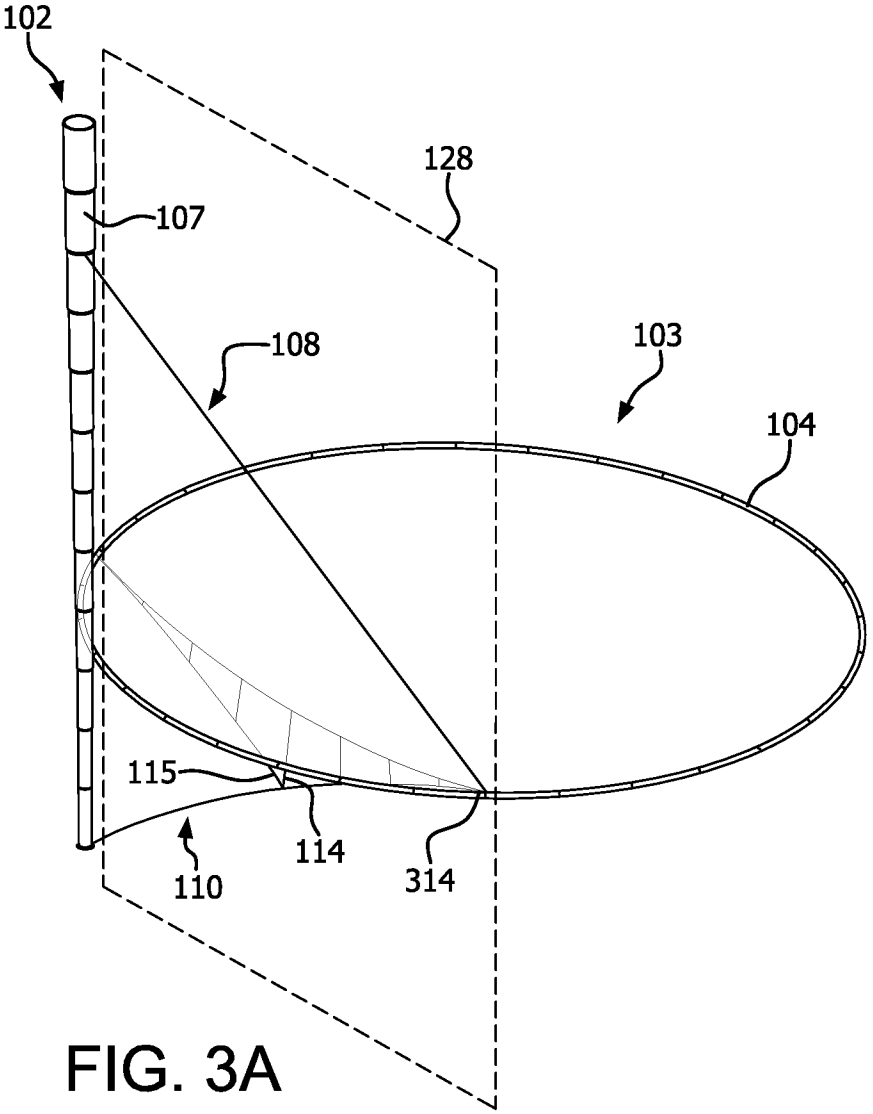

Upon extension of the boom to a deployed condition, the hoop assembly 104 is fully supported by the boom as shown in FIG. 1D. A plurality of secondary catenary cords 115, each respectively extends from a portion 120 of the hoop assembly that is adjacent to the extendible boom, to a corresponding primary catenary cord 110. As may be understood with reference to FIGS. 3A and 3B, each of the secondary catenary cords 115 can be advantageously aligned in a cord plane 128 with the corresponding primary catenary cord 110, a corresponding one of the hoop positioning cords 108, and a plurality of tie shaping cords 114 described below. In FIGS. 3A and 3B the housing 101 is omitted for greater clarity.

The mesh reflector surface 106 has a predetermined shape when the hoop assembly is deployed such that the reflector surface will concentrate RF energy in a predetermined pattern. The predetermined shape of the reflector surface 106 includes a reflector surface contour which is determined by a plurality of surface shaping tie cords 114 that extend between the reflector surface 106 and at least one of the primary catenary cords 110 and the secondary catenary cords 115. As such, the mesh reflector surface can be parabolic or can be specially shaped in accordance with the needs of a particular design. For example, in some scenarios the reflector surface can be specially shaped in accordance with a predetermined polynomial function. Further, the reflector surface 106 can be a surface of revolution, but it should be understood that this is not a requirement. There are some instances when the reflector surface can be an axi-symmetric shape, for example, in order to concentrate RF energy into a predetermined non-symmetric pattern.

It can be observed in FIG. 1 that a central axis 109 of the hoop assembly is substantially parallel to the central axis 111 of the extendible boom and laterally offset in position relative to a central axis of the extendible boom. The offset is a first predetermined distance d1 when the hoop assembly is in the collapsed configuration shown in FIG. 1B, and a second predetermined distance d2, which is greater than the first predetermined distance d1, when the hoop assembly 104 is in the expanded configuration shown in FIG. 1D. In the expanded configuration, the central axis 109 may remain substantially parallel to the central axis 111 of the extendible boom or may be inclined at a slight angle, such as 5° or 10°, in order to change the angle of incidence of the RF beam.

When the hoop assembly is fully deployed as shown in FIG. 1D, the central axis 109 is laterally offset in position by a distance d relative to the central axis 111 of the extendible boom. To facilitate this arrangement the mast assembly 102 can comprise counterbalancing structural components which are configured to counterbalance bending loads applied to the extendible boom. For example, in some scenarios the counterbalance structural components include one or more struts 121 which are disposed on the boom at intermediate portion 113. The struts 121 advantageously extend transverse to the central axis 111 of the extendible boom when the boom is extended. For example, a spring bias element (not shown) provided for each strut 121 can urge the struts into a position shown in FIG. 1D after the boom is urged from the housing 101. Further, one or more mast stability tension cords 112 can be respectively supported on the one or more struts 121. The mast stability tension cords can be secured to cord anchors 136, 138 so as to extend between the top and bottom portions 117, 119 of the boom. This configuration results in a truss-like structure which counteracts bending forces applied to the boom.

A drive train assembly 116 is positioned within the housing 101 and is configured to extend the boom 107 from the stowed configuration shown in FIG. 1A to the deployed configuration shown in FIG. 1D. The extending of the boom can be facilitated in accordance with various different conventional mechanisms. The exact mechanism selected for this purpose is not critical. As such, suitable arrangements can include mechanisms which involve telescoping sections, mechanisms which operate in accordance with scissoring action and spoolable extensible members (SEM) which unroll from a drum or spool to form rigid members. As used herein, a SEM can comprise any of a variety of deployable structure types that can be flattened and stowed on a spool for stowage, but when deployed or unspooled will exhibit beam-like structural characteristics whereby they become stiff and capable of carrying bending and column loads. Deployable structures of this type come in a wide variety of different configurations which are known in the art. Examples include slit-tube or Storable Tubular Extendible Member (STEM), Triangular Rollable and Collapsible (TRAC) boom, Collapsible Tubular Mast (CTM), and so on. Each of these SEM types are well-known and therefore will not be described here in detail.

In other scenarios, the mast assembly 102 may include a plurality of links joined by hinges which are moveable between a collapsed configuration wherein the link members extend substantially parallel to one another and an expanded configuration wherein the link members align co-linear to one other. As another example, the extendible mast assembly may include a plurality of links that slide relative to one another such that the mast assembly automatically extends from a collapsed configuration where the links are nested together and an expanded configuration wherein the link members extend substantially end to end. These and other mast configurations are described in greater detail in U.S. Pat. No. 9,608,333 which is incorporated herein by reference.

As explained hereinafter, the hoop assembly 104 is advantageously configured to be self-deploying such that the deployed hoop structure shown in FIG. 1D is achieved without any motors or actuators other than those which may be associated with the drive train assembly 116 which is used to extend the mast. Still, the solution is not limited in this respect and in some scenarios a motorized or actuated deployment of the hoop is contemplated. The exact arrangement of the hoop assembly is not critical. However, an exemplary hoop assembly as described herein can be similar to one or more hoop assemblies as disclosed in U.S. Pat. No. 9,608,333 which is incorporated herein by reference.

Figure 4:
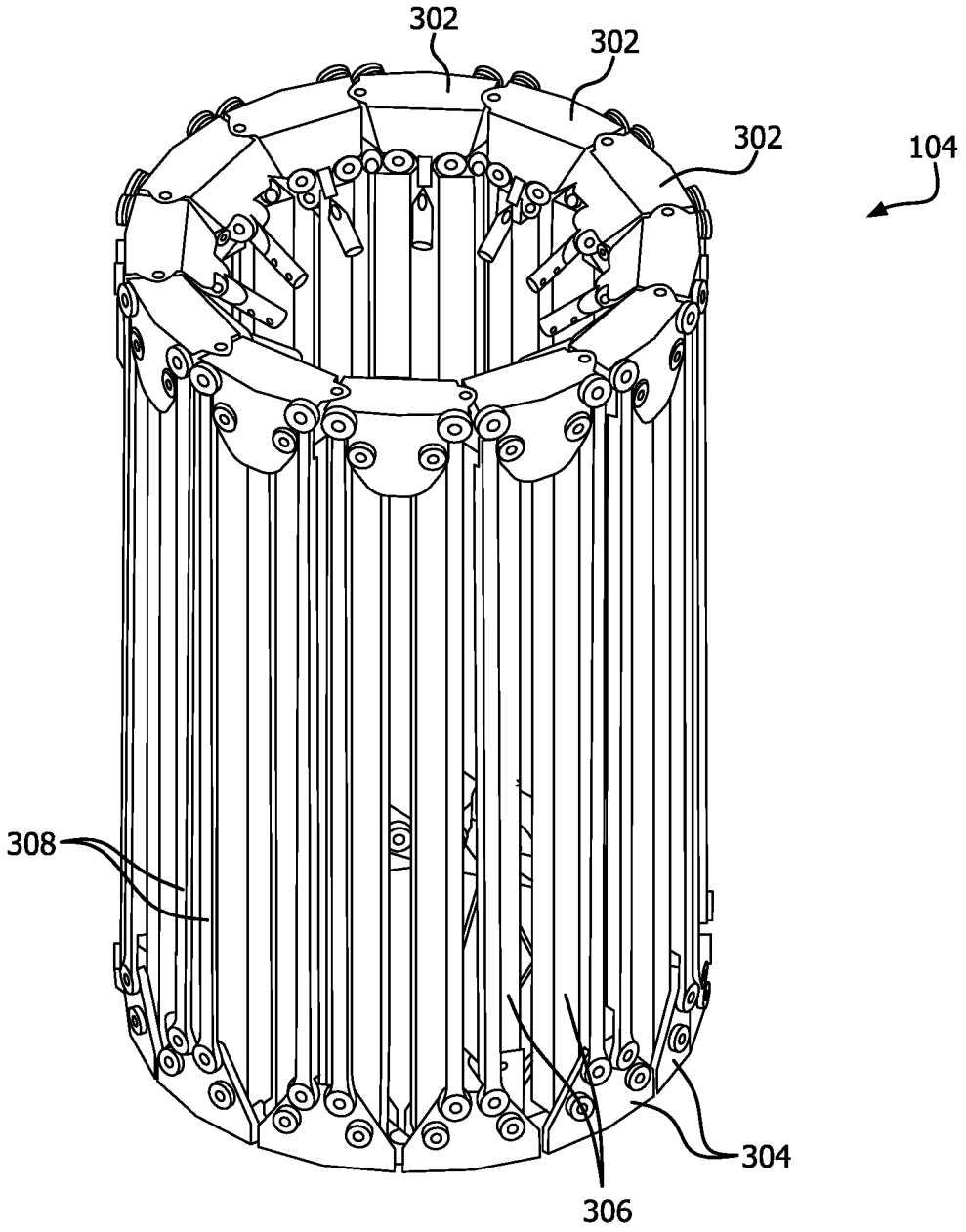
FIG. 4 is a drawing which is useful for understanding certain details of a hoop assembly which can be used with the reflector system.
Figure 5:
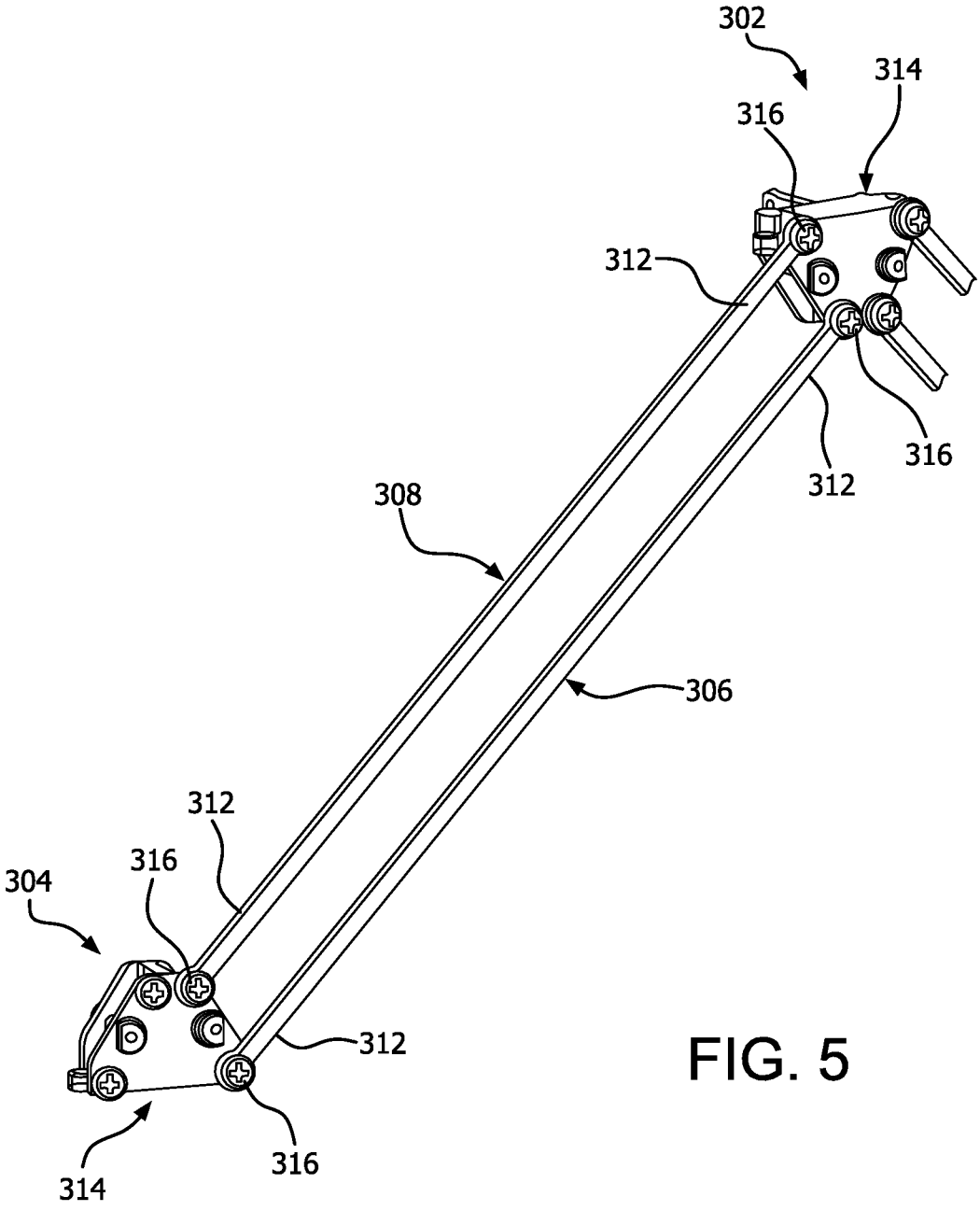
FIG. 5 is a drawing which is useful for understanding certain details of hinges and links which are included in the hoop assembly in FIG. 4.

Certain details of an exemplary hoop assembly 104 are illustrated with respect to FIGS. 4 and 5 so as to facilitate an understanding of the solution presented herein. The hoop assembly 104 can be comprised of a plurality of upper hinge members 302 which are interconnected with a plurality of lower hinge members 304 via link members 306. Each link member 306 is comprised of a linear rod which extends between opposed hinge members. In the stowed configuration illustrated in FIG. 4, the upper hinge members 302 collapse adjacent to one another and the lower hinge members 304 collapse adjacent to one another with the link members 306 extending therebetween in generally parallel alignment. One or two sync rods 308 may extend between each connected upper and lower hinge member 302, 304.

As shown in FIG. 5, the link member 306 and the sync rod 308 are elongated rods extending between opposed ends 312. Each end 312 is configured to be pivotally connected to a respective hinge body 314 of an upper and lower hinge 302, 304 at a pivot point 316. Accordingly, as the hinge members 302, 304 are moved apart as shown in FIG. 5, the link members 306 pivot and the sync rods 308 maintain the rotation angle between adjacent hinge members 302, 304. This arrangement facilitates synchronous deployment of the hoop assembly 104. The hoop may be driven from a stowed state to a deployed state by springs, motors, cord tension, or other mechanism. In some scenarios, the hoop extends via torsion springs (not shown) which are disposed on the hinges 302, 304. The torsion springs are biased to deploy the reflector to the configuration shown in FIG. 1D.

As shown in FIGS. 4 and 5, the upper and lower hinge members 302, 304 are circumferentially offset from one another such that a pair of adjacent link members 306 which are connected to one upper hinge member 302 are connected to two adjacent, but distinct lower hinge members 304. In this manner, upon deployment, the hoop assembly 104 defines a continuous circumferential hoop structure with link members extending between alternating upper and lower hinge members (see e.g., FIG. 2).

The configuration of the hoop assembly 104 as shown in FIGS. 4 and 5 is one possible configuration of a hoop assembly. However, it should be understood that the solution is not intended to be limited to the particular hoop assembly configuration shown. In this regard it may be understood that other types of synchronizing arrangements (using synchronizing gears, for example) can be used to coordinate and synchronize the deployment of the link members. All such configurations are intended within the scope of the solution presented herein, whether now known or known in the future.

The mesh reflector surface 106 is secured at its periphery to the hoop assembly 104 and collapses and extends therewith. Hoop positioning cords 108 and primary catenary cords 110 attach selected hinge bodies 314 to both top and bottom portions 117, 119 of the boom 107. Accordingly, a load path goes from one end of the boom, to the hinge bodies 314 and to the other end of the boom using the cords. The hoop positioning cords 108 and the primary catenary cords 110 maintain the hoop assembly 104 in a plane. Additional surface shaping tie cords 114 that extend between the reflector surface 106 and at least one of the primary catenary cords 110 and the secondary catenary cords 115 are used to pull the mesh down into a predetermined shape selected for the reflector surface. Accordingly, the hoop assembly 104 is not required to have depth out of plane to form the reflector into a parabola.

Figure 6:
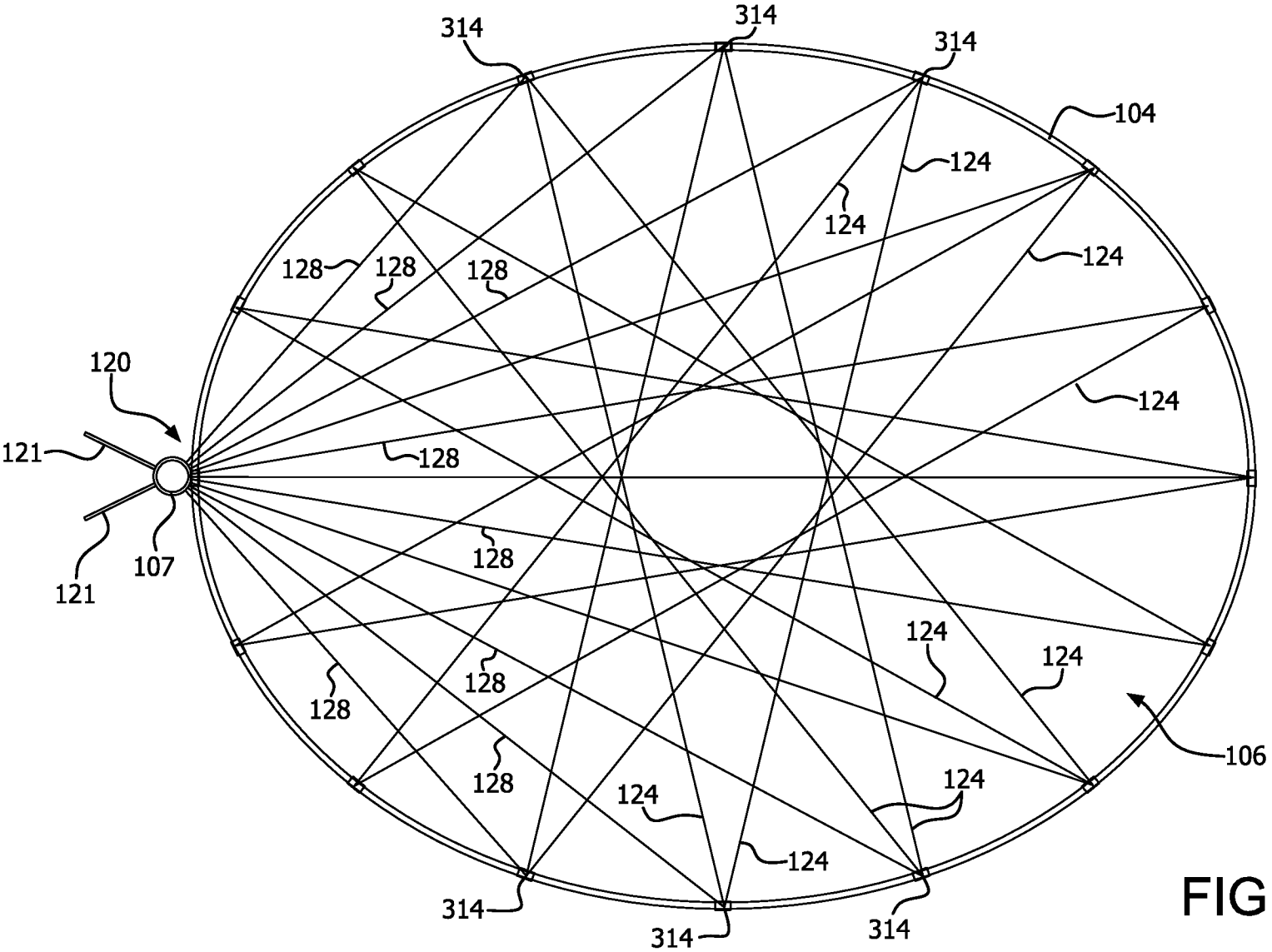
FIG. 6 is a top view of the reflector system which is useful for understanding an arrangement of hoop stability cords which are used to maintain a perimeter shape of the hoop assembly when fully deployed.

Unbalanced forces applied to the hoop assembly by the hoop positioning cords 108, primary catenary cords 110, secondary catenary cords 115, and tie cords 114 can tend to distort the perimeter shape of the hoop assembly 104. To prevent such distortion and maintain a predetermined perimeter shape, hoop stability cords 124 are provided which extend directly across the aperture of the hoop assembly 104 between hinge bodies 314. The exact configuration of these hoop stability cords can depend in part on the perimeter shape of the hoop assembly that is to be maintained. In some scenarios the hoop stability cords 124 can extend between offset opposing hinge bodies 314 as shown in FIG. 6, such that the cords do not extend directly across the center of the hoop aperture. In other scenarios, the hoop stability cords 124 can extend directly across the central axis of the hoop. However, the hoop stability cords are configured to maintain the desired perimeter shape of the hoop assembly.

Figure 7:
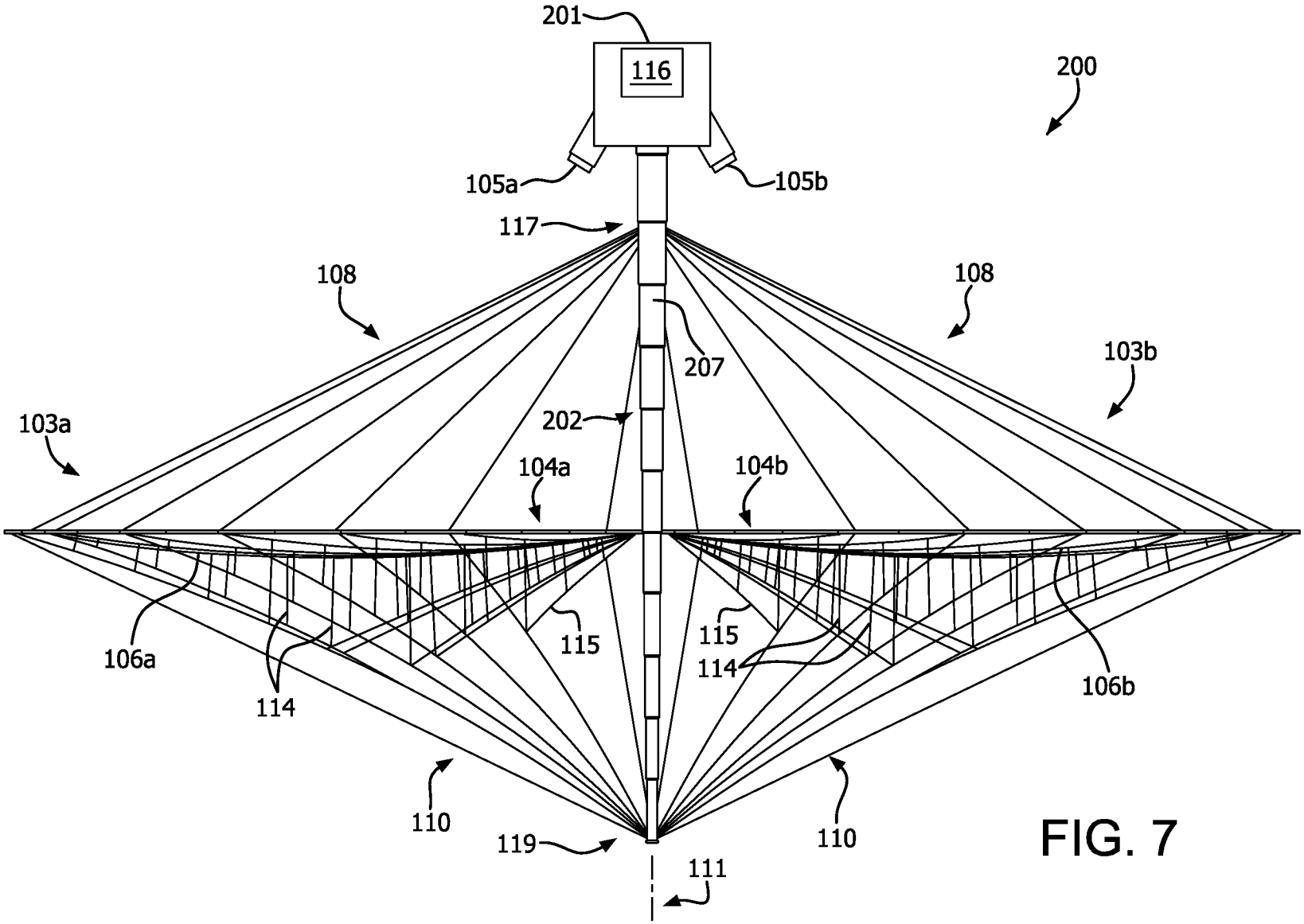
FIG. 7 is a side view of an alternative embodiment reflector system incorporating two reflector surfaces.

In some scenarios it can be advantageous to include more than one reflector as part of an antenna system. In such scenarios, a deployable mesh reflector system 200 can be provided which is similar to reflector system 100, but comprised of dual reflector assemblies 103*a*, 103*b* so as to achieve the configuration shown in FIG. 7. The reflector assemblies 103*a*, 103*b* can each be similar to reflector assembly 103 described herein. As such, each reflector assembly 103*a*, 103*b* can be stowed within an interior space of a housing or container 201, also includes space for stowing of a mast assembly 202. The housing 201 can comprise a portion of a spacecraft which includes various types of equipment, including radio communication equipment. The radio communication equipment can include separate RF feed 105*a*, 105*b* which are respectively configured for illuminating the reflector systems 103*a*, 103*b* with RF energy in a transmit mode, and for receiving RF energy which is focused by the reflector on the feed 105*a*, 105*b* in a receive direction. Accordingly, the combination of the RF feeds 105*a*, 105*b* and the reflector assemblies 103*a*, 103*b* can facilitate a reflector type antenna system.

The mast assembly 202 is similar to the mast assembly 102 insofar as it includes an extendable boom 207. The extendable boom 207 is similar to extendable boom 107 but is configured to support the reflector assemblies 103*a*, 103*b* on opposing sides of its central axis 111. The reflector assemblies 103*a*, 103*b* respectively comprise collapsible, mesh reflector surfaces 106*a*, 106*b* which are respectively supported by circumferential hoop assemblies 104*a*, 104*b*. The reflector assemblies 103*a*, 103*b* and the mast assembly 202 are configured to collapse into a stowed configuration which fits within the interior space of the housing 201. When the antenna system arrives at a deployment location (e.g., an orbital location) the antenna can be transitioned to the deployed configuration shown in FIG. 7 in a manner similar to that described herein with respect to system 100.

Each hoop assembly 104*a*, 104*b* is supported by the boom 207 by means of a plurality of cords in a manner similar to that which has been described herein with respect to reflector system 100. Accordingly, support for each hoop assembly can include a plurality of hoop positioning cords 108 which extend to the hoop assembly from a top portion 117 of the boom, and a plurality of primary catenary cords 110 which extend to a bottom portion 119 of the boom. A plurality of secondary catenary cords 115, each respectively extends from a portion of the hoop assembly that is adjacent to the extendible boom, to a corresponding primary catenary cord 110. As may be understood with reference to FIGS. 3A and 3B, each of the plurality of secondary catenary cords 115 is aligned in a cord plane 128 with a corresponding one of the primary catenary cords 110 and a corresponding one of the hoop positioning cords 108. Further, surface shaping tie cords 114 can extend between the reflector surface 106 and at least one of the primary catenary cords 110 and the secondary catenary cords 115.

The presence of the second reflector assembly supported on the boom 207 advantageously balances the bending forces that are applied to the boom. As such, the reflector system 200 differs from reflector system 100 insofar as it does not require counterbalancing structural components such as struts 121, and stability tension cords 112 to counterbalance bending loads applied to the extendible boom 207.

Furthermore, the described features, advantages and characteristics disclosed herein may be combined in any suitable manner. One skilled in the relevant art will recognize, in light of the description herein, that the disclosed systems and/or methods can be practiced without one or more of the specific features. In other instances, additional features and advantages may be recognized in certain scenarios that may not be present in all instances.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

We claim:

1. A reflector system, comprising:

a hoop assembly comprising a plurality of link members extending between a plurality of hinge bodies, the hoop assembly configured to automatically, passively expand between a collapsed configuration wherein the link members extend substantially parallel to one another and an expanded configuration wherein the link members define a circumferential hoop;

a collapsible mesh reflector surface secured to the hoop assembly such that when the hoop assembly is in the collapsed configuration, the reflector surface is collapsed within the hoop assembly and when the hoop assembly is in the expanded configuration, the reflector surface is expanded to a predetermined shape that is intended to concentrate RF energy in a desired pattern; and a mast assembly including an extendible boom, wherein the hoop assembly is secured by a plurality of hoop positioning cords relative to a top portion of the boom and by a plurality of primary catenary cords to a bottom portion of the boom such that upon extension of the boom to a deployed condition, the hoop assembly is supported by the boom, wherein a central axis of the hoop assembly is substantially parallel or forms a slight angle to the central axis of the extendible boom and is offset in position relative to a central axis of the extendible boom.

2. The reflector system of claim 1, wherein the offset is a first predetermined distance when the hoop assembly is in the collapsed configuration, and a second predetermined distance greater than the first predetermined distance when the hoop assembly is in the expanded configuration.

3. The reflector system of claim 1 wherein each of the link members in the hoop is biased toward the deployed configuration with a spring member.

4. The reflector system of claim 1 wherein the end of adjacent link members engage at the hinge and are configured to synchronize the rotation angle between adjacent link members for synchronous deployment.

5. The reflector system of claim 1, further comprising a plurality of secondary catenary cords, each respectively extending from an intermediate portion of the extendible boom to a corresponding primary catenary cord.

6. The reflector system of claim 5, wherein each of the plurality of secondary catenary cords is aligned in a cord plane with a corresponding one of the primary catenary cords and a corresponding one of the hoop positioning cords.

7. The reflector system of claim 5, wherein the predetermined shape includes a reflector surface contour which is determined by a plurality of surface shaping ties that extend between the reflector surface and at least one of the primary catenary cords and the secondary catenary cords.

8. The reflector system of claim 1, wherein the predetermined shape includes a perimeter shape of the hoop assembly when in the deployed condition, and the perimeter shape is fixed by a plurality of hoop stability cords which extend across the hoop assembly.

9. The reflector system of claim 1 wherein the extendible boom is comprised of a plurality of links that slide relative to one another, such that the extendible boom automatically extends from a collapsed configuration where the links are nested together and an expanded configuration wherein the link members extend substantially end to end.

10. The reflector system of claim 1, wherein the extendible boom is comprised of a spoolable extensible member.

11. The reflector system of claim 1, wherein the mast assembly further comprises counterbalance structural components which are configured to counterbalance bending loads on the extendible boom.

12. The reflector system of claim 11, wherein the counterbalance structural components include one or more struts disposed on the boom, the struts extending transverse to the central axis of the extendible boom intermediate of the top and bottom portions, and one or more mast stability tension cords which are respectively supported on the one or more struts, the mast stability tension cords extending between the top and bottom portions of the boom.

13. The reflector system of claim 1, further comprising a second said hoop assembly including a second collapsible mesh reflector surface secured to the second hoop assembly such that when the second hoop assembly is in the collapsed configuration, the second collapsible mesh reflector surface is collapsed within the second hoop assembly and when the second hoop assembly is in the expanded configuration, the second collapsible mesh reflector surface is expanded to a second predetermined shape that is intended to concentrate RF energy in a second desired pattern.

14. The reflector system of claim 13 wherein a second central axis of the second hoop assembly is substantially parallel to the central axis of the extendible boom and offset in position relative to the central axis of the extendible boom and relative to the central axis of the first hoop assembly.

15. A reflector system, comprising:

a hoop assembly comprising a plurality of link members extending between a plurality of hinge bodies, the hoop assembly configured to automatically expand between a collapsed configuration wherein the link members extend substantially parallel to one another and an expanded configuration wherein the link members define a circumferential hoop having a central hoop axis;

a collapsible mesh reflector surface secured to the hoop assembly with a plurality of cords such that when the hoop assembly is in the collapsed configuration, the reflector surface is collapsed within the hoop assembly and when the hoop assembly is in the expanded configuration, the reflector surface is expanded to a shape that is intended to concentrate RF energy in a desired pattern;

a mast assembly including an extendible boom aligned along a central boom axis, wherein the hoop assembly is secured by a plurality of cords relative to a top portion of the mast and to a bottom portion of the mast such that upon extension of the mast to a deployed condition, the hoop assembly is supported by the extendible boom in a position adjacent to the mast assembly, with the central hoop axis laterally offset a predetermined distance from the central boom axis.

16. The reflector system of claim 15, further comprising a housing in which the hoop assembly, collapsible mesh reflector surface and mast assembly are stowed prior to deployment.

17. The reflector system of claim 16, further comprising a slide mechanism which is configured to urge the hoop assembly from the housing prior to full deployment of the extendible boom.

18. The reflector system of claim 15, wherein the central boom axis is external of a perimeter of the hoop assembly.

19. A method of deploying a reflector of a reflector system comprising a housing, a hoop assembly positioned in the housing and comprising a plurality of link members extending between a plurality of hinge bodies, the hoop assembly biased to move from a collapsed configuration wherein the link members extend substantially parallel to one another to an expanded configuration wherein the link members define a circumferential hoop; a collapsible mesh reflector surface secured to the hoop assembly such that when the hoop assembly is in the collapsed configuration, the reflector surface is collapsed within the hoop assembly and when the hoop assembly is in the expanded configuration, the reflector surface is expanded to a shape that is intended to concentrate RF energy in a desired pattern; and a mast assembly including an extendible boom, wherein selected ones of the hinge bodies are secured by cords relative to a top portion of the mast and a bottom portion of the mast, the method comprising:

extending the boom such that a cord tension between the hinges and the mast facilitates a controlled deployment of the hoop assembly in a position adjacent to the boom such that a central axis of the hoop assembly is substantially parallel or forms a slight angle with a central axis of the boom but is offset a predetermined distance whereby the central axis of the boom is external of a perimeter of the hoop assembly.

20. The method of claim 19, further comprising urging the hoop assembly out of the housing prior to fully deploying the boom.

* * * * *